US009102884B2

(12) United States Patent
Xu et al.

(10) Patent No.: US 9,102,884 B2
(45) Date of Patent: Aug. 11, 2015

(54) HYDROPROCESSED PRODUCT

(75) Inventors: Teng Xu, Houston, TX (US); Paul M. Edwards, Romsey (GB); Stephen H. Brown, Annandale, NJ (US); Frank C. Wang, Annandale, NJ (US); S. Mark Davis, Humble, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 361 days.

(21) Appl. No.: 13/601,113

(22) Filed: Aug. 31, 2012

(65) Prior Publication Data

US 2014/0061094 A1 Mar. 6, 2014

(51) Int. Cl.

| | |
|---|---|
| ***C10C 1/00*** | (2006.01) |
| ***C10C 1/08*** | (2006.01) |
| ***C10L 1/04*** | (2006.01) |
| ***C10G 49/00*** | (2006.01) |
| ***C10G 69/06*** | (2006.01) |
| ***C10G 9/36*** | (2006.01) |

(52) U.S. Cl.

CPC ... *C10L 1/04* (2013.01); *C10G 9/36* (2013.01); *C10G 49/00* (2013.01); *C10G 69/06* (2013.01); *C10G 2300/301* (2013.01); *C10G 2300/302* (2013.01); *C10L 2200/0407* (2013.01)

(58) Field of Classification Search

CPC ..... C10G 2300/30; C10G 2300/1096; C10G 49/00; C10G 69/06; C10G 9/36; C10G 2300/302; C10G 2300/301; C10L 2200/0407; C10L 1/04

USPC ..... 208/14, 15, 16, 17, 18, 19, 20, 21, 22, 208/23

See application file for complete search history.

(56) References Cited

U.S. PATENT DOCUMENTS

| | | | | |
|---|---|---|---|---|
| 3,817,853 | A * | 6/1974 | Folkins | 208/50 |
| 4,173,529 | A | 11/1979 | Bauer | |
| 4,225,415 | A | 9/1980 | Mirza et al. | |
| 4,448,670 | A * | 5/1984 | Dickakian | 208/22 |
| 4,846,958 | A | 7/1989 | Feldman et al. | |
| 5,069,775 | A | 12/1991 | Grosboll | |
| 5,158,668 | A | 10/1992 | Chahar et al. | |
| 5,215,649 | A | 6/1993 | Grenoble et al. | |
| 5,370,787 | A | 12/1994 | Forbus, Jr. | |
| 5,871,634 | A | 2/1999 | Wiehe et al. | |
| 7,578,929 | B2 | 8/2009 | Stell et al. | |
| 8,083,931 | B2 | 12/2011 | McCoy et al. | |
| 2007/0007170 | A1 | 1/2007 | Strack et al. | |
| 2007/0090018 | A1 | 4/2007 | Keusenkothen et al. | |
| 2007/0163921 | A1 | 7/2007 | Keusenkothen et al. | |
| 2009/0057200 | A1 | 3/2009 | Leta et al. | |
| 2010/0089794 | A1 * | 4/2010 | Bhan et al. | 208/15 |
| 2010/0326887 | A1 | 12/2010 | McGehee et al. | |
| 2011/0005970 | A1 | 1/2011 | Ou et al. | |
| 2011/0174681 | A1 * | 7/2011 | Milam et al. | 208/14 |
| 2013/0178673 | A1 * | 7/2013 | Kim et al. | 585/253 |
| 2014/0174980 | A1 * | 6/2014 | Brown et al. | 208/15 |

FOREIGN PATENT DOCUMENTS

| | | |
|---|---|---|
| GB | 1159843 | 7/1969 |
| GB | 2 194 794 | 3/1988 |
| GB | 2194794 | 3/1988 |

* cited by examiner

*Primary Examiner* — Pamela H Weiss

(57) ABSTRACT

The invention relates to a hydroprocessed product that can be produced by hydroprocessing tar, such as a tar obtained from hydrocarbon pyrolysis. The invention also relates to methods for producing such a hydroprocessed product, and the use of such a product, e.g., as a fuel oil blending component.

10 Claims, 2 Drawing Sheets

HYDROPROCESSED PRODUCT

FIELD

The invention relates to a hydroprocessed product that can be produced by hydroprocessing tar, such as a tar obtained from hydrocarbon pyrolysis. The invention also relates to methods for producing such a hydroprocessed product, and the use of such a product, e.g., as a fuel oil blending component.

BACKGROUND

Pyrolysis processes such as steam cracking can be utilized for converting saturated hydrocarbon to higher-value products such as light olefin, e.g., ethylene and propylene. Besides these useful products, hydrocarbon pyrolysis can also produce a significant amount of relatively low-value products such as steam-cracker tar ("SCT").

SCT upgrading processes involving conventional catalytic hydroprocessing suffer from significant catalyst deactivation. The process can be operated at a temperature in the range of from 250° C. to 380° C., at a pressure in the range of 5400 kPa to 20,500 kPa, using catalysts containing one or more of Co, Ni, or Mo; but significant catalyst coking is observed. Although catalyst coking can be lessened by operating the process at an elevated hydrogen partial pressure, diminished space velocity, and a temperature in the range of 200° C. to 350° C.; SCT hydroprocessing under these conditions is undesirable because increasing hydrogen partial pressure worsens process economics, as a result of increased hydrogen and equipment costs, and because the elevated hydrogen partial pressure, diminished space velocity, and reduced temperature range favor undesired hydrogenation reactions.

SUMMARY

In an embodiment, the invention relates to hydroprocessed product, comprising: ≥10.0 wt. % based on the weight of the hydroprocessed product of compounds selected from the group consisting of:

(i) compounds in the 1.0 ring molecular class,
(ii) compounds in the 1.5 ring molecular class,
(iii) compounds defined in (i) or (ii) further comprising one or more alkyl or alkenyl substituents on any ring,
(iv) compounds defined in (i), (ii) or (iii) further comprising hetero atoms selected from sulfur, nitrogen or oxygen, and
(v) combinations thereof;

wherein the hydroprocessed product has a viscosity ≥2.0 cSt at 50° C., and ≥1.0 wt. % of the hydroprocessed product comprises compounds having an atmospheric boiling point ≥565° C.

In another embodiment, the invention relates to a hydroprocessed product produced by the method comprising:

(a) providing a hydrocarbon mixture comprising ≥2 wt. % sulfur, and ≥0.1 wt. % of Tar Heavies, the weight percents being based on the weight of the hydrocarbon mixture;
(b) combining the hydrocarbon mixture with a utility fluid to produce a feed mixture, the utility fluid comprising aromatics and having an ASTM D86 10% distillation point ≥60° C. and a 90% distillation point ≤360° C., wherein the feed mixture comprises 20 wt. % to 95 wt. % of the hydrocarbon mixture and 5 wt. % to 80 wt. % of the utility fluid based on the weight of the feed mixture;

(c) contacting the feed mixture with at least one hydroprocessing catalyst under catalytic hydroprocessing conditions in the presence of molecular hydrogen to convert at least a portion of the feed mixture to a conversion product, the conversion product comprising hydroprocessed product; and
(d) separating the hydroprocessed product from the conversion product, wherein the hydroprocessed product comprises ≥10.0 wt. % based on the weight of the hydroprocessed product of compounds selected from the group consisting of
(i) compounds of 1.0 ring molecular class,
(ii) compounds of 1.5 ring molecular class,
(iii) compounds defined in (i) or (ii) further comprising one or more alkyl or alkenyl substituents on any ring,
(iv) compounds defined in (i), (ii) or (iii) further comprising hetero atoms selected from sulfur, nitrogen or oxygen, and
(v) combinations thereof, and wherein the hydroprocessed product has a viscosity and sulfur content less than that of the hydrocarbon mixture.

In yet another embodiment, the invention relates to a hydroprocessed product made by a hydrocarbon conversion method, comprising:

(a) providing a hydrocarbon mixture comprising ≥2 wt. % sulfur, and ≥0.1 wt. % of Tar Heavies, the weight percents being based on the weight of the hydrocarbon mixture;
(b) combining the hydrocarbon mixture with a utility fluid to produce a feed mixture, the utility fluid comprising aromatics and having an ASTM D86 10% distillation point ≥60° C. and a 90% distillation point ≤360° C., wherein the feed mixture comprises 20 wt. % to 95 wt. % of the hydrocarbon mixture and 5 wt. % to 80 wt. % of the utility fluid based on the weight of the feed mixture;
(c) contacting the feed mixture with at least one hydroprocessing catalyst under catalytic hydroprocessing conditions in the presence of molecular hydrogen to convert at least a portion of the feed mixture to a conversion product, the conversion product comprising a hydroprocessed product having an atmospheric boiling point >360° C.; and
(d) separating the hydroprocessed product from the conversion product, wherein the hydroprocessed product comprises ≥10.0 wt. % based on the weight of the hydroprocessed product of compounds selected from the group consisting of:
(i) compounds in the 1.0 ring molecular class,
(ii) compounds in the 1.5 ring molecular class,
(iii) compounds defined in (i) or (ii) further comprising one or more alkyl or alkenyl substituents on any ring,
(iv) compounds defined in (i), (ii) or (iii) further comprising hetero atoms selected from sulfur, nitrogen or oxygen, and
(v) combinations thereof, and wherein the hydroprocessed product has a viscosity and sulfur content less than that of the hydrocarbon mixture.

In another embodiment, the invention relates to a hydroprocessed tar, comprising: ≥10.0 wt. % based on the weight of the hydroprocessed tar of compounds selected from the group consisting of:

(i) compounds in the 1.0 ring molecular class,
(ii) compounds in the 1.5 ring molecular class,
(iii) compounds defined in (i) or (ii) further comprising one or more alkyl or alkenyl substituents on any ring, (iv) compounds defined in (i), (ii) or (iii) further comprising hetero atoms selected from sulfur, nitrogen or oxygen, and (v) combinations thereof, wherein the hydroprocessed tar has a viscosity ≥2.0 cSt at 50° C., and ≥1.0 wt. % of the hydroprocessed tar comprises compounds having an atmospheric boiling point ≥565° C. Optionally, the hydroprocessed tar comprises ≥90.0 wt. % of hydroprocessed SCT based on the weight of the hydroprocessed tar. Optionally, the hydroprocessed tar is utilized to produce a blend, e.g., a mixture comprising (i) one or more of heavy fuel oil, vapor-liquid separator bottoms, fractionator tower bottoms, or SCT and (ii) ≥5.0 wt. % of the hydroprocessed tar, the weight percents being based on the weight of the mixture.

In yet another embodiment, the invention relates to a hydroprocessed product made by a hydrocarbon conversion method, comprising:

(a) providing a hydrocarbon mixture comprising ≥2 wt. % sulfur, and ≥0.1 wt. % of Tar Heavies, the weight percents being based on the weight of the hydrocarbon mixture;

(b) combining the hydrocarbon mixture with a utility fluid to produce a feed mixture, the utility fluid comprising aromatics and having an ASTM D86 10% distillation point ≥60° C. and a 90% distillation point ≤360° C., wherein the feed mixture comprises 20 wt. % to 95 wt. % of the hydrocarbon mixture and 5 wt. % to 80 wt. % of the utility fluid based on the weight of the feed mixture;

(c) contacting the feed mixture with at least one hydroprocessing catalyst under catalytic hydroprocessing conditions in the presence of molecular hydrogen to convert at least a portion of the feed mixture to a conversion product, the conversion product comprising a hydroprocessed product having an atmospheric boiling point >360° C.; and (d) separating the hydroprocessed product from the conversion product, wherein the hydroprocessed product comprises ≥10.0 wt. % based on the weight of the hydroprocessed product of compounds selected from the group consisting of:

(vii) compounds in the 1.0 ring molecular class, (viii) compounds in the 1.5 ring molecular class, (ix) compounds defined in (i) or (ii) further comprising one or more alkyl or alkenyl substituents on any ring, (x) compounds defined in (i), (ii) or (iii) further comprising hetero atoms selected from sulfur, nitrogen or oxygen, and (xi) combinations thereof, and wherein the hydroprocessed product has a viscosity and sulfur content less than that of the hydrocarbon mixture.

DETAILED DESCRIPTION

Figure 1:
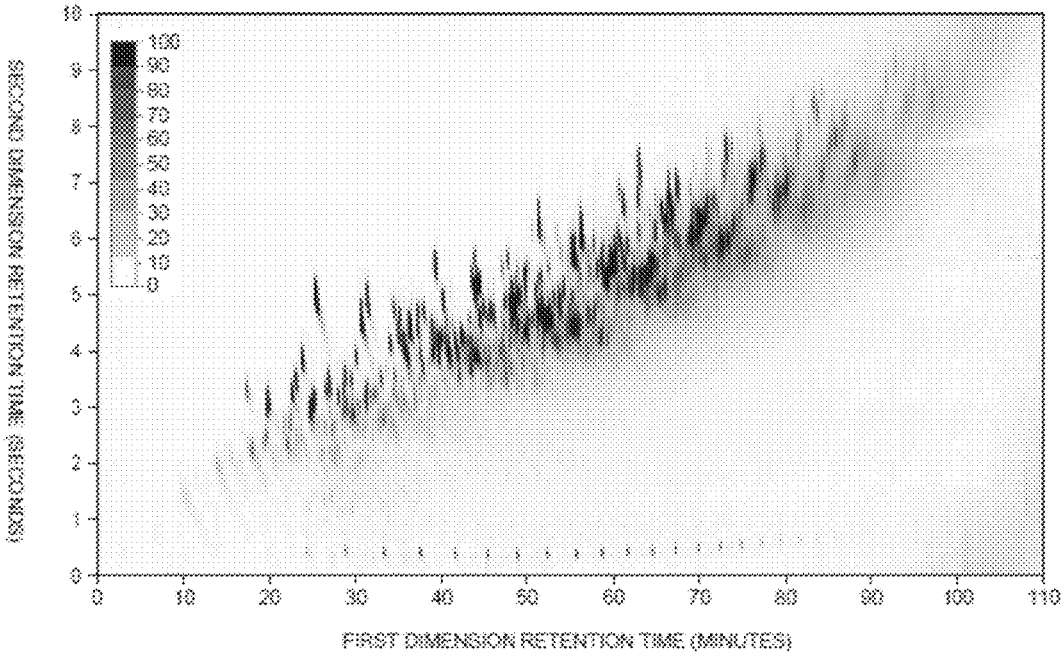
FIG. 1 shows a 2D GC Chromatogram obtained from a hydroprocessed product.

The invention is based in part on the discovery that a hydroprocessed product having desirable properties can be made by hydroprocessing tar from pyrolysis of hydrocarbons, such as SCT, in the presence of a utility fluid comprising a significant amount of single or multi-ring aromatics. Unlike conventional SCT hydroprocessing, the process can be operated at temperatures and pressures that favor the desired hydrocracking reaction over aromatics hydrogenation. The term "SCT" means (a) a mixture of hydrocarbons having one or more aromatic core and optionally (b) non-aromatic and/or non-hydrocarbon molecules, the mixture being derived from hydrocarbon pyrolysis and having a boiling range ≥about 550° F. (290° C.) e.g., ≥90.0 wt. % of the SCT molecules have an atmospheric boiling point ≥550° F. (290° C.). SCT can comprise, e.g., ≥50.0 wt. %, e.g., ≥75.0 wt. %, such as ≥90.0 wt. %, based on the weight of the SCT, of hydrocarbon molecules (including mixtures and aggregates thereof) having (i) one or more aromatic cores and (ii) a molecular weight ≥about $C_{15}$.

The hydroprocessed product (and the SCT from which it can be derived) comprises to a large extent a mixture of multi-ring compounds. The rings can be aromatic or non-aromatic and can contain a variety of substituents and/or heteroatoms. For example, the hydroprocessed product can contain, e.g., ≥10.0 wt. %, or ≥20.0 wt. %, or ≥30.0 wt. %, based on the weight of the hydroprocessed product, of aromatic and non-aromatic multi-ring compounds. The hydroprocessed product can be made by hydroprocessing a heavy tar stream made in one or more hydrocarbon pyrolysis processes such as steam cracking, the hydroprocessing being carried out in the presence of the specified utility fluid. In certain embodiments, the hydroprocessing produces a highly-aromatic hydrocarbon having an atmospheric boiling point in the range of a heavy distillate, VGO, or even heavier hydrocarbon. Such products are generally useful as, e.g., a blending component for fuel oil.

In this description and appended claims, a molecule having 0.5 rings means a molecule having only one non-aromatic ring and no aromatic rings.

The term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure are within the scope of the term "non-aromatic ring".

Examples of non-aromatic rings include:

(i) a pentacyclic ring—five carbon member ring such as

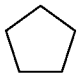

cyclopentane (ii) a hexcyclic ring—six carbon member ring such as

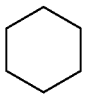

cyclohexane

The non-aromatic ring can be statured as exemplified above or partially unsaturated for example, cyclopentene, cyclopenatadiene, cyclohexene and cyclohexadiene.

Non aromatic rings (which in SCT and the hydroprocessed product derived therefrom are primarily six and five member non-aromatic rings), can contain one or more heteroatoms such as sulfur (S), nitrogen (N) and oxygen (O). Non limiting examples of non-aromatic rings with heteroatoms includes the following

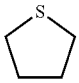
tetrahydrothiophene

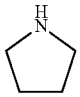
pyrrolidine

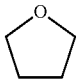
tetrahydrofuran

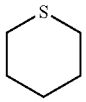
tetrahydro-2H-thiopyran

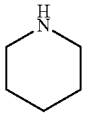
piperidine

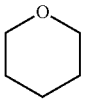
tetrahydro-2H-pyran

The non-aromatic rings with hetero atoms can be statured as exemplified above or partially unsaturated.

In this description and appended claims, a molecule having 1.0 ring means a molecule having only one aromatic ring or a molecule having only 2 non-aromatic rings and no aromatic rings. The term "aromatic ring" means five or six joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "non-aromatic ring".

Representative aromatic rings include, e.g.:

(i) a benzene ring

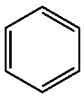
benzene (ii) a thiophene ring such as

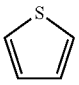
thiophene (iii) a pyrrole ring such as

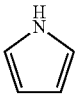
1H-pyrrole (iv) a furan ring such as

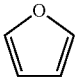
furan

When there is more than one ring in a molecular structure, the rings can be aromatic rings and/or non-aromatic rings. The ring to ring connection can be of two types: type (1) where at least one side of the ring is shared, and type (2) where the rings are connected with at least one bond. The type (1) structure is also known as a fused ring structure. The type (2) structure is also commonly known as a bridged ring structure.

A few non-limiting examples of the type (1) fused ring structure are as follows:

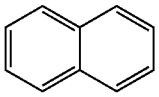
naphthalene

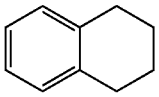
1,2,3,4-tetrahydronaphthalene

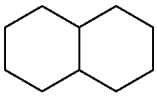
decahydronaphthalene

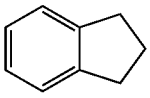
indane

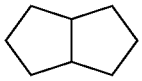
octahydropentalene

A non-limiting example of the type (2) bridged ring structure is as follows:

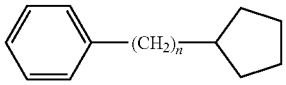

where $n$ = 0,1,2, or 3.

When there are two or more rings (aromatic rings and/or non-aromatic rings) in a molecular structure, the ring to ring connection may include all type (1) or type (2) connections or a mixture of both types (1) and (2).

The following define the molecular classes for the multi-ring compounds for the purpose of this description and appended claims:

Compounds of the 1.0 ring molecular class contain the following ring structures but no other rings:

(i) one aromatic ring 1• (1.0 ring) in the molecular structure, or (ii) two non-aromatic rings 2• (0.5 ring) in the molecular structure.

Compounds of the 1.5 ring molecular class contain the following ring structures, but no other rings:

(i) one aromatic ring 1• (1.0 ring) and one non-aromatic ring 1• (0.5 ring) in the molecular structure or (ii) three non-aromatic rings 3(0.5 ring) in the molecular structure.

Compounds of the 2.0 ring molecular class contain the following ring structures, but no other rings:

(i) two aromatic rings 2• (1.0 ring) or (ii) one aromatic ring 1• (1.0 ring) and two non-aromatic rings 2• (0.5 ring) in the molecular structure, or (iii) four non-aromatic rings 4• (0.5 ring) in the molecular structure.

Compounds of the 2.5 ring molecular class contain the following ring structures but no other rings:

(i) two aromatic rings 2• (1.0 ring) and one non-aromatic rings 1• (0.5 ring) in the molecular structure or (ii) one aromatic ring 1• (1.0 ring) and three non-aromatic rings 3• (0.5 ring) in the molecular structure or (iii) five non-aromatic rings 5• (0.5 ring) in the molecular structure.

Likewise compounds of the 3.0, 3.5, 4.0, 4.5, 5.0, etc. molecular classes contain a combination of non-aromatic rings counted as 0.5 ring, and aromatic rings counted as 1.0 ring, such that the total is 3.0, 3.5, 4.0, 4.5, 5.0, etc. respectively.

All of these multi-ring molecular classes include ring compounds having hydrogen, alkyl, or alkenyl groups bound thereto, e.g., one or more of H, $CH_2$, $C_2H_4$ through $C_n H_{2n}$, $CH_3$, $C_2H_5$ through $C_n H_{2n+1}$. Generally, n is in the range of from 1 to 6, e.g., from 1 to 5.

One skilled in the art can determine the types and amounts of compounds in the multi-ring molecular classes defined above in, e.g., the hydroprocessed product and the SCT from which it can be derived. Conventional methods can be utilized to do this, though the invention is not limited thereto. For example, it has been found that two-dimensional gas chromatography ("2D GC") is a convenient methodology for performing a quantitative analysis of samples of tar, hydroprocessed product, and other streams and mixtures as might result from operating certain embodiments of the invention. The use of two-dimensional chromatography as an analytic tool for identifying the types and amounts of compounds of the specified molecular classes will now be described in more detail. The invention is not limited to this method, and this description is not meant to foreclose other methods for identifying molecular types and amounts within the broader scope of the invention, e.g., other gas chromatography/mass spectrometry (GC/MS) techniques.

Two-Dimensional Gas Chromatography

In (2D GC), a sample is subjected to two sequential chromatographic separations. The first separation is a partial separation by a first or primary separation column. The partially separated components are then injected into a second or secondary column where they undergo further separation. The two columns usually have different selectivities to achieve the desired degree of separation. An example of 2D GC may be found in U.S. Pat. No. 5,169,039, which is incorporated by reference herein in its entirety.

A sample is injected into an inlet device connected to the inlet of the first column to produce a first dimension chromatogram. The sample injection method used is not critical, and the use of conventional sample injection devices such as a syringe is suitable, though the invention is not limited thereto. In certain embodiments, the inlet device holds a single sample, although those that hold multiple samples for injection into the first column are within the scope of the invention. The column generally contains a stationary phase which is usually the column coating material.

The first column is generally coated with a non-polar material. When column coating material is methyl silicon polymer, the polarity can be measured by the percentage of methyl groups substituted by the phenyl group. The polarity of a particular coating material can be measured on a % of phenyl group substitution scale from 0 to 100 with zero being non-polar and 80 (80% phenyl substitution) being polar. These methyl silicon polymers are considered non-polar and have polarity values in the range 0 to 20. Phenyl-substituted methyl silicon polymers are considered semi-polar and have polar values of 21 to 50. Phenyl-substituted methyl silicon polymer coating materials are considered polar when greater than 51% phenyl-substituted methyl groups are included in the polymers. Other polar coating polymers, such as carbowaxes, are also used in chromatographic applications. Carbowaxes are polyethylene glycols of higher molecular weight. A series of carborane silicon polymers sold under the trade name Dexsil have also been designed especially for high temperature applications.

The first column, coated with a non-polar material, provides a first separation of the sample. The first separation, also known as the first dimension, generates a series of bands over a specified time period. This first dimension chromatogram is similar to a conventional one-dimensional chromatogram. The bands represent individual components or groups of components of the sample injected, and are generally fully separated or partially overlapped with adjacent bands.

When the complex mixture is separated by the first dimension column, it still suffers from many co-elutions (components not fully separated by the first dimension column). The bands of separated materials from the first dimension are then completely sent to the second column to undergo further separation, especially on the co-eluted components. The materials are further separated in the second dimension. The second dimension is obtained from a second column coated with a semi-polar or polar material, preferably a semi-polar coating material.

To facilitate acquisition of the detector signal, a modulator is utilized to manage the flow between the end of the first column and the beginning of the second column. Suitable modulators include thermal modulators utilizing trap/release mechanism, such as those in which cold nitrogen gas is used to trap separated sample from the first dimension followed by a periodic pulse of hot nitrogen to release trapped sample to the second dimension. Each pulse is analogous to a sample injection into the second dimension.

The role of the modulator is to (1) collect the continuous eluent flow out from the end of the first column with a fixed period of time (modulated period) and (2) inject to the beginning of the second column by release collected eluent at once at the end of the modulated period. The function of the modulator is to (1) define the beginning time of a specific second dimensional column separation and (2) define the length of the second dimensional separation (modulation period).

The separated bands from the second dimension are coupled with the bands from the first dimension to form a comprehensive 2D chromatogram. The bands are placed in a retention plane wherein the first dimension retention times and the second dimension retention times form the axes of the 2D chromatogram.

For example, a conventional GC experiment takes 110 minutes to separate a mixture (a chromatogram with 110 minute retention time, x-axis). When the same experiment is performed under 2D GC conditions with 10 second modulation period, it will become 660 chromatograms (60 second× 110 minute divided 10 second) where each 10 second chromatogram (y-axis) lines up one-by-one along the retention time axis (x-axis). In 2D GC, the x-axis is the first dimension retention time (the same as in conventional GC), the y-axis is the second dimensional retention time, and the peak intensity would project out in the third dimension z-axis. In order to express this 3D picture in a two dimensional diagram, the intensity can be converted based on a pre-defined gray scale (from black to white with different shades of grey) or a pre-defined color table to express their relative peak intensity.

FIG. 1 shows a 2D GC of a hydroprocessed product sample obtained by hydroprocessing SCT in the presence of the specified utility fluid under the specified hydroprocessing conditions.

The 2D GC (GC×GC) system utilizes an Agilent 6890 gas chromatograph (Agilent Technology, Wilmington, Del.) configured with inlet, columns, and detectors. A split/splitless inlet system with an eight-vial tray autosampler was used.

Figure 2:
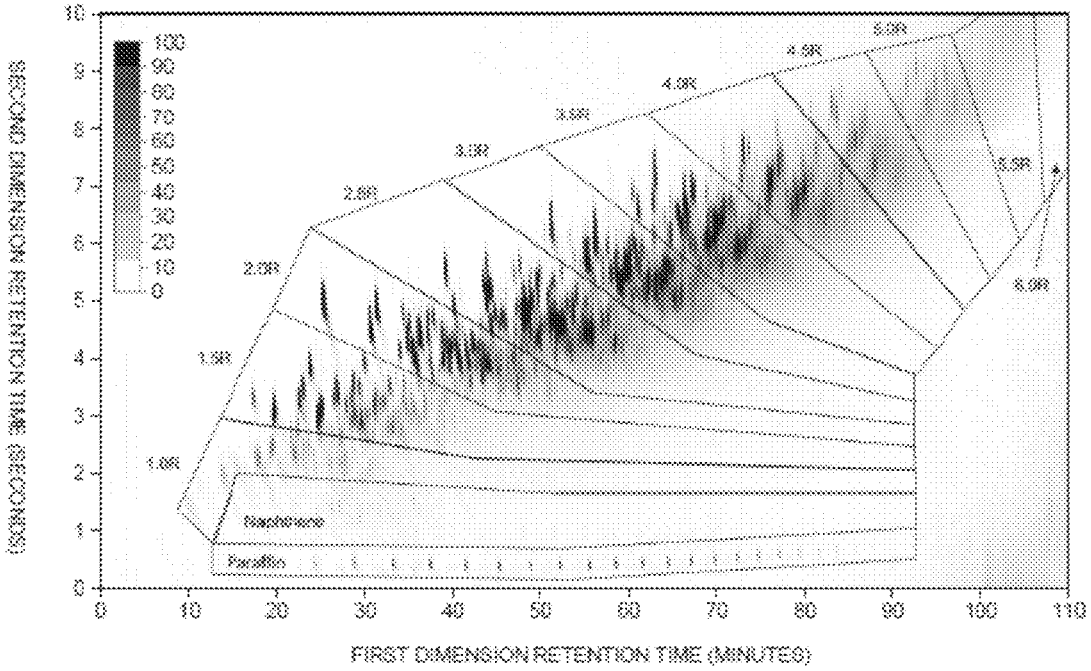
FIG. 2 shows the molecular classes identified in the chromatogram of FIG. 1.

The two-dimensional capillary column system utilizes a non-polar first column (BPX-5, 30 meter, 0.25 mm I.D., 1.0 μm film), and a polar (BPX-50, 2 meter, 0.25 mm I.D., 0.25 μm film), second column. Both capillary columns are obtained from SGE Inc. Austin, Tex. A looped single jet thermal modulation assembly based on ZOEX technology (ZOEX Corp. Lincoln, Nebr.) which is a liquid nitrogen cooled "trap-release" dual jet thermal modulator is installed between these two columns. A flame ionization detector (FID) is used for the signal detection. A 1.0 microliter sample is injected with 25:1 split at 300° C. from Inlet. Carrier gas flow is substantially constant at 2.0 mL/min. The oven is programmed from 60° C. with 0 minute hold and 3.0° C. per minute increment to 390° C. with 0 minute hold. The total GC run time is 110 minutes. The modulation period is 10 seconds. The sampling rate for the detector is 100 Hz. FIGS. 1 and 2 show a conventional quantitative analysis of the 2D GC data, utilizing a commercial program ("Transform" (Research Systems Inc. Boulder, Colo.) and "PhotoShop" program (Adobe System Inc. San Jose, Calif.) to generate the images.

SCT

It has been observed that SCT comprises a significant amount of Tar Heavies ("TH"). For the purpose of this description and appended claims, the term "Tar Heavies" means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. ("conventional pentane extraction"). The TH can include high-molecular weight molecules (e.g., MW≥600) such as asphaltenes and other high-molecular weight hydrocarbon. The term "asphaltene or asphaltenes" is defined as heptane insolubles, and is measured following ASTM D3279. For example, the TH can comprise ≥10.0 wt. % of high molecular-weight molecules having aromatic cores that are linked together by one or more of (i) relatively low molecular-weight alkanes and/or alkenes, e.g., $C_1$ to $C_3$ alkanes and/or alkenes, (ii) $C_5$ and/or $C_6$ cycloparaffinic rings, or (iii) thiophenic rings. Generally, ≥60.0 wt. % of the TH's carbon atoms are included in one or more aromatic cores based on the weight of the TH's carbon atoms, e.g., in the range of 68.0 wt. % to 78.0 wt. %. While not wishing to be bound by any theory or model, it is also believed that the TH form aggregates having a relatively planar morphology, as a result of Van der Waals attraction between the TH molecules. The large size of the TH aggregates, which can be in the range of, e.g., ten nanometers to several hundred nanometers ("nm") in their largest dimension, leads to low aggregate mobility and diffusivity under catalytic hydroprocessing conditions. In other words, conventional TH conversion suffers from severe mass-transport limitations, which result in a high selectivity for TH conversion to coke. It has been found that combining SCT with the utility fluid breaks down the aggregates into individual molecules of, e.g., ≤5.0 nm in their largest dimension and a molecular weight in the range of about 200 grams per mole to 2500 grams per mole. This results in greater mobility and diffusivity of the SCT's TH, leading to shorter catalyst-contact time and less conversion to coke under hydroprocessing condition. As a result, SCT conversion can be run at lower pressures, e.g., 500 psig to 1500 psig (34.5 to 103.4 bar gauge), leading to a significant reduction in cost and complexity over higher-pressure hydroprocessing. The invention is also advantageous in that the SCT is not over-cracked so that the amount of light hydrocarbons produced, e.g., $C_4$ or lighter, is less than 5 wt. %, which results in a unique composition of multi ring compounds, and further reduces the amount of hydrogen consumed in the hydroprocessing step.

SCT starting material differs from other relatively high-molecular weight hydrocarbon mixtures, such as crude oil residue ("resid") including both atmospheric and vacuum resids and other streams commonly encountered, e.g., in petroleum and petrochemical processing. The SCT's aromatic carbon content as measured by $^{13}C$ NMR is substantially greater than that of resid. For example, the amount of aromatic carbon in SCT typically is greater than 70 wt. % while the amount of aromatic carbon in resid is generally less than 40 wt. %. A significant fraction of SCT asphaltenes have an atmospheric boiling point that is less than 565° C., for example, only 32.5 wt. % of asphaltenes in SCT 1 have an atmospheric boiling point that is greater than 565° C. That is not the case with vacuum resid. Even though solvent extraction is an imperfect process, results indicate that asphaltenes in vacuum resid are mostly heavy molecules having atmospheric boiling point that is greater than 565° C. When subjected to heptane solvent extraction under substantially the same conditions as those used for vacuum resid, the asphaltenes obtained from SCT contains a much greater percentage (on a wt. basis) of molecules having an atmospheric boiling point <565° C. than is the case for vacuum resid. SCT also differs from resid in the relative amount of metals and nitrogen-containing compounds present. In SCT, the total amount of metals is ≤1000.0 ppmw (parts per million, weight) based on the weight of the SCT, e.g., ≤100.0 ppmw, such as ≤10.0 ppmw. The total amount of nitrogen present in SCT is generally less than the amount of nitrogen present in a crude oil vacuum resid.

Selected properties of two representative SCT samples and three representative resid samples are set out in the following table.

TABLE 1

| | SCT 1 | SCT 2 | RESID 1 | RESID 2 | RESID 3 |
|---|---|---|---|---|---|
| CARBON (wt. %) | 89.9 | 91.3 | 86.1 | 83.33 | 82.8 |
| HYDROGEN (wt. %) | 7.16 | 6.78 | 10.7 | 9.95 | 9.94 |
| NITROGEN (wt. %) | 0.16 | 0.24 | 0.48 | 0.42 | 0.4 |
| OXYGEN (wt. %) | 0.69 | N.M. | 0.53 | 0.87 | |
| SULFUR (wt. %) | 2.18 | 0.38 | 2.15 | 5.84 | 6.1 |
| Kinematic Viscosity at 50° C. (cSt) | 988 | 7992 | >1,000 | >1,000 | >1,000 |
| Weight % having an atmospheric boiling point ≥565° C. | 16.5 | 20.2 | | | |
| Asphaltenes | 22.6 | 31.9 | 91 | 85.5 | 80 |
| NICKEL wppm | <0.7 | N.M.* | 52.5 | 48.5 | 60.1 |
| VANADIUM wppm | 0.22 | N.M. | 80.9 | 168 | 149 |
| IRON wppm | 4.23 | N.M. | 54.4 | 11 | 4 |
| Aromatic Carbon (wt. %) | 71.9 | 75.6 | 27.78 | 32.32 | 32.65 |
| Aliphatic Carbon (wt. %) | 28.1 | 24.4 | 72.22 | 67.68 | 67.35 |
| Methyls (wt. %) | 11 | 7.5 | 9.77 | 13.35 | 11.73 |
| % C in long chains (wt. %) | 0.7 | 0.63 | 11.3 | 15.28 | 10.17 |
| Aromatic H (wt. %) | 38.1 | 43.5 | N.M. | N.M. | 6.81 |
| % Sat H (wt. %) | 60.8 | 55.1 | N.M. | N.M. | 93.19 |
| Olefins (wt. %) | 1.1 | 1.4 | N.M. | N.M. | 0 |

*N.M. = Not Measured

The amount of aliphatic carbon and the amount of carbon in long chains is substantially lower in SCT compared to resid. Although the SCT's total carbon is only slightly higher and the oxygen content (wt. basis) is similar to that of resid, the SCT's metals, hydrogen, and nitrogen (wt. basis) range is considerably lower. The SCT's kinematic viscosity at 50° C. is generally ≥100 cSt, or ≥1000 cSt even though the relative amount of SCT having an atmospheric boiling point ≥565° C. is much less than is the case for resid.

SCT is generally obtained as a product of hydrocarbon pyrolysis. The pyrolysis process can include, e.g., thermal pyrolysis, such as thermal pyrolysis processes utilizing water. One such pyrolysis process, steam cracking, is described in more detail below. The invention is not limited to steam cracking, and this description is not meant to foreclose the use of other pyrolysis processes within the broader scope of the invention.

Obtaining SCT by Pyrolysis

Conventional steam cracking utilizes a pyrolysis furnace which has two main sections: a convection section and a radiant section. The feedstock (first mixture) typically enters the convection section of the furnace where the first mixture's hydrocarbon component is heated and vaporized by indirect contact with hot flue gas from the radiant section and by direct contact with the first mixture's steam component. The steam-vaporized hydrocarbon mixture is then introduced into the radiant section where the bulk cracking takes place. A second mixture is conducted away from the pyrolysis furnace, the second mixture comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, water, unreacted hydrocarbon components of the first mixture, etc. The separation stage can comprise, e.g., a primary fractionator. Generally, a cooling stage, typically either direct quench or indirect heat exchange is located between the pyrolysis furnace and the separation stage.

In one or more embodiments, SCT is obtained as a product of pyrolysis conducted in one or more pyrolysis furnaces, e.g., one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules and mixtures thereof. The liquid-phase products are generally conducted together to a separation stage, e.g., a primary fractionator, for separations of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) bottoms comprising ≥90.0 wt. % SCT, based on the weight of the bottoms, the SCT having a boiling range ≥about 550° F. (290° C.) and comprising molecules and mixtures thereof having a molecular weight ≥about $C_{15}$.

The feed to the pyrolysis furnace is a first mixture, the first mixture comprising ≥10.0 wt. % hydrocarbon based on the weight of the first mixture, e.g., ≥25.0 wt. %, ≥50.0 wt. %, such as ≥65 wt. %. Although the hydrocarbon can comprise, e.g., one or more of light hydrocarbons such as methane, ethane, propane, butane etc., it can be particularly advantageous to utilize the invention in connection with a first mixture comprising a significant amount of higher molecular weight hydrocarbons because the pyrolysis of these molecules generally results in more SCT than does the pyrolysis of lower molecular weight hydrocarbons. As an example, it can be advantageous for the total of the first mixtures fed to a multiplicity of pyrolysis furnaces to comprise ≥1.0 wt. % or ≥25.0 wt. % based on the weight of the first mixture of hydrocarbons that are in the liquid phase at ambient temperature and atmospheric pressure.

The first mixture can further comprise diluent, e.g., one or more of nitrogen, water, etc., e.g., ≥1.0 wt. % diluent based on the weight of the first mixture, such as ≥25.0 wt. %. When the pyrolysis is steam cracking, the first mixture can be produced by combining the hydrocarbon with a diluent comprising steam, e.g., at a ratio of 0.1 to 1.0 kg steam per kg hydrocarbon, or a ratio of 0.2 to 0.6 kg steam per kg hydrocarbon.

In one or more embodiments, the first mixture's hydrocarbon component comprises ≥10.0 wt. %, e.g., ≥50.0 wt. %, such as ≥90.0 wt. % (based on the weight of the hydrocarbon component) of one or more of naphtha, gas oil, vacuum gas oil, crude oil, resid, or resid admixtures; including those comprising ≥about 0.1 wt. % asphaltenes. Suitable crude oils include, e.g., high-sulfur virgin crude oils, such as those rich in polycyclic aromatics. Optionally, the first mixture's hydrocarbon component comprises sulfur, e.g., ≥0.1 wt. % sulfur based on the weight of the first mixture's hydrocarbon component, e.g., ≥1.0 wt. %, such as in the range of about 1.0 wt. % to about 5.0 wt. %. Optionally, at least a portion of the first mixture's sulfur-containing molecules, e.g., ≥10.0 wt. % of the first mixture's sulfur-containing molecules, contain at least one aromatic ring ("aromatic sulfur"). When (i) the first mixture's hydrocarbon is a crude oil or crude oil fraction comprising ≥0.1 wt. % of aromatic sulfur and (ii) the pyrolysis is steam cracking, then the, SCT contains a significant amount of sulfur derived from the first mixture's aromatic sulfur. For example, the SCT sulfur content can be about 3 to 4 times higher in the SCT than in the first mixture's hydrocarbon component, on a weight basis.

In a particular embodiment, the first mixture's hydrocarbon comprises one or more crude oils and/or one or more crude oil fractions, such as those obtained from an atmospheric pipestill ("APS") and/or vacuum pipestill ("VPS"). The crude oil and/or fraction thereof is optionally desalted prior to being included in the first mixture. An example of a crude oil fraction utilized in the first mixture is produced by combining separating APS bottoms from a crude oil and followed by VPS treatment of the APS bottoms.

Optionally, the pyrolysis furnace has at least one vapor/liquid separation device (sometimes referred to as flash pot or flash drum) integrated therewith, for upgrading the first mixture. Such vapor/liquid separator devices are particularly suitable when the first mixture's hydrocarbon component comprises ≥about 0.1 wt. % asphaltenes based on the weight of the first mixture's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; and 7,235,705, which are incorporated by reference herein in their entirety. Suitable vapor/liquid separation devices are also disclosed in U.S. Pat. Nos. 6,632,351 and 7,578,929, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, at least a portion of the first mixture's hydrocarbon component is provided to the inlet of a convection section of a pyrolysis unit, wherein hydrocarbon is heated so that at least a portion of the hydrocarbon is in the vapor phase. When a diluent (e.g., steam) is utilized, the first mixture's diluent component is optionally (but preferably) added in this section and mixed with the hydrocarbon component to produce the first mixture. The first mixture, at least a portion of which is in the vapor phase, is then flashed in at least one vapor/liquid separation device in order to separate and conduct away from the first mixture at least a portion of the first mixture's high molecular-weight molecules, such as asphaltenes. A bottoms fraction can be conducted away from the vapor-liquid separation device, the bottoms fraction comprising, e.g., ≥10.0% (on a wt. basis) of the first mixture's asphaltenes. When the pyrolysis is steam cracking and the first mixture's hydrocarbon component comprises one or more crude oil or fractions thereof, the steam cracking furnace can be integrated with a vapor/liquid separation device operating at a temperature in the range of from about 600° F. to about 950° F. and a pressure in the range of about 275 kPa to about 1400 kPa, e.g., a temperature in the range of from about 430° C. to about 480° C. and a pressure in the range of about 700 kPa to 760 kPa. The overheads from the vapor/liquid separation device can be subjected to further heating in the convection section, and are then introduced via crossover piping into the radiant section where the overheads are exposed to a temperature ≥760° C. at a pressure ≥0.5 bar (gauge) e.g., a temperature in the range of about 790° C. to about 850° C. and a pressure in the range of about 0.6 bar (gauge) to about 2.0 bar (gauge), to carry out the pyrolysis (e.g., cracking and/or reforming) of the first mixture's hydrocarbon component.

One of the advantages of having a vapor/liquid separation device located downstream of the convection section inlet and upstream of the crossover piping to the radiant section is that it increases the range of hydrocarbon types available to be used directly, without pretreatment, as hydrocarbon components in the first mixture. For example, the first mixture's hydrocarbon component can comprise ≥50.0 wt. %, e.g., ≥75.0 wt. %, such as ≥90.0 wt. % (based on the weight of the first mixture's hydrocarbon component) of one or more crude oils, even high naphthenic acid-containing crude oils and fractions thereof. Feeds having a high naphthenic acid content are among those that produce a high quantity of tar and are especially suitable when at least one vapor/liquid separation device is integrated with the pyrolysis furnace. If desired, the first mixture's composition can vary over time, e.g., by utilizing a first mixture having a first hydrocarbon component during a first time period and then utilizing a first mixture having a second hydrocarbon component during a second time period, the first and second hydrocarbons being substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This embodiment can be utilized for the sequential pyrolysis of incompatible first and second hydrocarbon components (i.e., where the first and second hydrocarbon components are mixtures that are not sufficiently compatible to be blended under ambient conditions). For example, a first hydrocarbon component comprising a virgin crude oil can be utilized to produce the first mixture during a first time period and steam cracked tar utilized to produce the first mixture during a second time period.

In other embodiments, the vapor/liquid separation device is not used. For example when the first mixture's hydrocarbon comprises crude oil and/or one or more fractions thereof, the pyrolysis conditions can be conventional steam cracking conditions. Suitable steam cracking conditions include, e.g., exposing the first mixture to a temperature (measured at the radiant outlet) ≥400° C., e.g., in the range of 400° C. to 900° C., and a pressure ≥0.1 bar, for a cracking residence time period in the range of from about 0.01 second to 5.0 second. In one or more embodiments, the first mixture comprises hydrocarbon and diluent, wherein the first mixture's hydrocarbon comprises ≥50.0 wt. % based on the weight of the first mixture's hydrocarbon of one or more of waxy residues, atmospheric residues, naphtha, residue admixtures, or crude oil. The diluent comprises, e.g., ≥95.0 wt. % water based on the weight of the diluent. When the first mixture comprises 10.0 wt. % to 90.0 wt. % diluent based on the weight of the first mixture, the pyrolysis conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A second mixture is conducted away from the pyrolysis furnace, the second mixture being derived from the first mixture by the pyrolysis. When the specified pyrolysis conditions are utilized, the second mixture generally comprises ≥1.0 wt. % of $C_2$ unsaturates and ≥0.1 wt. % of TH, the weight percents being based on the weight of the second mixture. Optionally, the second mixture comprises ≥5.0 wt. % of $C_2$ unsaturates and/or ≥0.5 wt. % of TH, such as ≥1.0 wt. % TH. Although the second mixture generally contains a mixture of the desired light olefins, SCN, SCGO, SCT, and unreacted components of the first mixture (e.g., water in the case of steam cracking, but also in some cases unreacted hydrocarbon), the relative amount of each of these generally depends on, e.g., the first mixture's composition, pyrolysis furnace configuration, process conditions during the pyrolysis, etc. The second mixture is generally conducted away for the pyrolysis section, e.g., for cooling and separation stages.

In one or more embodiments, the second mixture's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the second mixture. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the second mixture downstream of the pyrolysis furnace, e.g., the second mixture can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the second mixture can be subjected to direct quench at a point typically between the furnace outlet and the separation stage. The quench can be accomplished by contacting the second mixture with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench liquids include liquid quench oil, such as those obtained by a downstream quench oil knock-out drum, pyrolysis fuel oil and water, which can be obtained from conventional sources, e.g., condensed dilution steam.

A separation stage is generally utilized downstream of the pyrolysis furnace and downstream of the transfer line exchanger and/or quench point for separating from the second mixture one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. In the separation stage, a third mixture, tar stream can be separated from the second mixture, with the third mixture comprising ≥10.0 wt. % of the second mixture's TH based on the weight of the second mixture's TH. When the pyrolysis is steam cracking, the third mixture generally comprises SCT, which is obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof.

In one or more embodiments, the third mixture comprises ≥50.0 wt. % of the second mixture's TH based on the weight of the second mixture's TH. For example, the third mixture can comprise ≥90.0 wt. % of the second mixture's TH based on the weight of the second mixture's TH. The third mixture can have, e.g., (i) a sulfur content in the range of 0.5 wt. % to 7.0 wt. %, (ii) a TH content in the range of from 5.0 wt. % to 40.0 wt. %, the weight percents being based on the weight of the third mixture, (iii) a density at 15° C. in the range of 0.98 g/cm$^3$ to 1.15 g/cm$^3$, e.g., in the range of 1.07 g/cm$^3$ to 1.15 g/cm$^3$, and (iv) a 50° C. viscosity in the range of 200 cSt to $1.0\times10^7$ cSt.

The third mixture can comprise TH aggregates. In one or more embodiments, the third mixture comprises ≥50.0 wt. % of the second mixture's TH aggregates based on the weight of the second mixture's TH aggregates. For example, the third mixture can comprise ≥90.0 wt. % of the second mixture's TH aggregates based on the weight of the second mixture's TH aggregates.

The third mixture is generally conducted away from the separation stage for hydroprocessing of the third mixture in the presence of a utility fluid. Examples of utility fluids useful in the invention will now be described in more detail. The invention is not limited to the use of these utility fluids, and this description is not meant to foreclose other utility fluids within the broader scope of the invention.

Utility Fluid

The utility fluid comprises aromatics (i.e., comprises molecules having at least one aromatic core) and has an ASTM D86 10% distillation point ≥60° C. and a 90% distillation point ≤360° C. Optionally, the utility fluid (which can be a solvent or mixture of solvents) has an ASTM D86 10% distillation point ≥120° C., e.g., ≥140° C., such as ≥150° C. and/or an ASTM D86 90% distillation point ≤300° C.

In one or more embodiments, the utility fluid (i) has a critical temperature in the range of 285° C. to 400° C. and (ii) comprises ≥80.0 wt. % of 1-ring aromatics and/or 2-ring aromatics, including alkyl-functionalized derivatives thereof, based on the weight of the utility fluid. For example, the utility fluid can comprise, e.g., ≥90.0 wt. % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the utility fluid comprises ≥90.0 wt. % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins). It is generally desirable for the utility fluid to be substantially free of molecules having alkenyl functionality, particularly in embodiments utilizing a hydroprocessing catalyst having a tendency for coke formation in the presence of such molecules. In an embodiment, the utility fluid comprises ≤10.0 wt. % of ring compounds having $C_1$-$C_6$ sidechains with alkenyl functionality, based on the weight of the utility fluid.

In certain embodiments, the utility fluid comprises SCN and/or SCGO, e.g., SCN and/or SCGO separated from the second mixture in a primary fractionator downstream of a pyrolysis furnace operating under steam cracking conditions. Optionally, the SCN or SCGO can be hydrotreated in different conventional hydrotreaters (e.g. not hydrotreated with the tar). The utility fluid can comprise, e.g., ≥50.0 wt. % of the separated gas oil, based on the weight of the utility fluid. In certain embodiments, at least a portion of the utility fluid is obtained from the hydroprocessed product, e.g., by separating and re-cycling a portion of the hydroprocessed product having an atmospheric boiling point ≤300° C.

Generally, the utility fluid contains sufficient amount of molecules having one or more aromatic cores to effectively increase run length during hydroprocessing of the third mixture. For example, the utility fluid can comprise ≥50.0 wt. % of molecules having at least one aromatic core, e.g., ≥60.0 wt. %, such as ≥70 wt. %, based on the total weight of the utility fluid. In an embodiment, the utility fluid comprises (i) ≥60.0 wt. % of molecules having at least one aromatic core and (ii) ≤1.0 wt. % of ring compounds with $C_1$-$C_6$ sidechains having alkenyl functionality, the weight percents being based on the weight of the utility fluid.

The utility fluid is utilized in hydroprocessing the third mixture, e.g., for effectively increasing run-length during hydroprocessing. The relative amounts of utility fluid and third mixture during hydroprocessing are generally in the range of from about 20.0 wt. % to about 95.0 wt. % of the third mixture and from about 5.0 wt. % to about 80.0 wt. % of the utility fluid, based on total weight of utility fluid plus third mixture. For example, the relative amounts of utility fluid and third mixture during hydroprocessing can be in the range of (i) about 20.0 wt. % to about 90.0 wt. % of the third mixture and about 10.0 wt. % to about 80.0 wt. % of the utility fluid, or (ii) from about 40.0 wt. % to about 90.0 wt. % of the third mixture and from about 10.0 wt. % to about 60.0 wt. % of the utility fluid. At least a portion of the utility fluid can be combined with at least a portion of the third mixture within the hydroprocessing vessel or hydroprocessing zone, but this is not required, and in one or more embodiments at least a portion of the utility fluid and at least a portion of the third mixture are supplied as separate streams and combined into one feed stream prior to entering (e.g., upstream of) the hydroprocessing stage(s). For example, the third mixture and utility fluid can be combined to produce a feedstock upstream of the hydroprocessing stage, the feedstock comprising, e.g., (i) about 20.0 wt. % to about 90.0 wt. % of the third mixture and about 10.0 wt. % to about 80.0 wt. % of the utility fluid, or (ii) from about 40.0 wt. % to about 90.0 wt. % of the third mixture and from about 10.0 wt. % to about 60.0 wt. % of the utility fluid, the weight percents being based on the weight of the feedstock. The feedstock can be conducted to the hydroprocessing stage for the hydroprocessing.

Hydroprocessing

Hydroprocessing of the third mixture in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the third mixture in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt. % of one or more metals selected from Groups 6, 8, 9, and 10 of the Periodic Table and (ii) ≥1.0 wt. % of an inorganic oxide, the weight percents being based on the weight of the catalyst.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Hydroprocessing the specified amounts of third mixture and utility fluid using the specified hydroprocessing catalyst leads to improved catalyst life, e.g., allowing the hydroprocessing stage to operate for at least 3 months, or at least 6 months, or at least 1 year without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the third mixture and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 S $m^3/m^3$) to 5000 SCF/B (890 S $m^3/m^3$), in which B refers to barrel of feed to the hydroprocessing stage (e.g., third mixture plus utility fluid). For example, the molecular hydrogen can be provided in a range of from 1000 SCF/B (178 S $m^3/m^3$) to 3000 SCF/B (534 S $m^3/m^3$). Hydroprocessing the third mixture in the presence of the specified utility fluid, molecular hydrogen, and a catalytically effective amount of the specified hydroprocessing catalyst under catalytic hydroprocessing conditions produces a hydroprocessed product including, e.g., upgraded SCT. An example of suitable catalytic hydroprocessing conditions will now be described in more detail. The invention is not limited to these conditions, and this description is not meant to foreclose other hydroprocessing conditions within the broader scope of the invention.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified third mixture. The hydroprocessing reaction can be carried out in at least one vessel or zone that is located, e.g., within a hydroprocessing stage downstream of the pyrolysis stage and separation stage. The specified third mixture generally contacts the hydroprocessing catalyst in the vessel or zone, in the presence of the utility fluid and molecular hydrogen. Catalytic hydroprocessing conditions can include, e.g., exposing the combined diluent-third mixture to a temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Liquid hourly space velocity (LHSV) of the combined diluent-third mixture will generally range from 0.1 $h^{-1}$ to 30 $h^{-1}$, or 0.4 $h^{-1}$ to 25 $h^{-1}$, or 0.5

$h^{-1}$ to 20 $h^{-1}$. In some embodiments, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, or 20 bar to 120 bar, or 20 bar to 100 bar, a space velocity (LHSV) in the range of 0.1 to 5.0, and a molecular hydrogen consumption rate of about 53 standard cubic meters/cubic meter (S $m^3/m^3$) to about 445 S $m^3/m^3$ (300 SCF/B to 2500 SCF/B, where the denominator represents barrels of the third mixture, e.g., barrels of SCT). In one or more embodiment, the hydroprocessing conditions include one or more of a temperature in the range of 380° C. to 430° C., a pressure in the range of 21 bar (absolute) to 81 bar (absolute), a space velocity in the range of 0.2 to 1.0, and a hydrogen consumption rate of about 70 S $m^3/m^3$ to about 267 S $m^3/m^3$ (400 SCF/B to 1500 SCF/B). When operated under these conditions using the specified catalyst, TH hydroconversion conversion is generally ≥25.0% on a weight basis, e.g., ≥50.0%.

Hydroprocessed Product

In certain embodiments, an effluent is conducted away from the hydroprocessing stage(s), the effluent comprising liquid-phase and vapor-phase portions. The vapor-phase portion is generally separated from the effluent, e.g., by one or more vapor-liquid separators, and conducted away. Treat gas can be separated from the vapor portion for recycle and reuse, if desired.

In certain embodiments, a mixture comprising light hydrocarbons (a "light hydrocarbon mixture") is separated from the liquid-phase portion of the hydroprocessor effluent, the light hydrocarbon mixture comprising ≥90.0 wt. % of the liquid phase's molecules having atmospheric boiling point ≤300° C. based on the weight of the liquid-phase portion of the hydroprocessor effluent. The conversion product, i.e., the remainder of the liquid-phase portion of the hydroprocessor effluent following separation of the light hydrocarbon mixture generally comprises a hydroprocessed product.

In certain embodiments, hydroprocessed product comprises: ≥10.0 wt. % based on the weight of the hydroprocessed product, e.g., ≥20.0 wt. %, such as 20.0 wt. % to 40.0 wt. %, of one or more of (i) compounds in the 1.0 ring molecular class, (ii) compounds in the 1.5 ring molecular class, (iii) compounds defined in (i) or (ii) and further comprising one or more alkyl or alkenyl substituents on any ring, (iv) compounds defined in (i), (ii) or (iii) and further comprising hetero atoms selected from sulfur, nitrogen or oxygen. The hydroprocessed product can have, e.g., a viscosity ≥2.0 cSt at 50° C., e.g., in the range of 3.0 cSt to 50.0 cSt at 50° C. Generally, ≥1.0 wt. % of the hydroprocessed product comprises compounds having an atmospheric boiling point ≥565° C., e.g., 2.0 wt. % to 10.0 wt. % based on the weight of the hydroprocessed product. The hydroprocessed product can comprise, e.g., ≤50.0 wt. %, based on the weight of the hydroprocessed product, of compounds in the ring molecular classes of from 3.0 to 5.0, including those compounds having (i) one or more alkyl or alkenyl substituents on any ring and/or (ii) one or more hetero atoms selected from sulfur, nitrogen or oxygen. The hydroprocessed product can comprise, e.g., 20.0 wt. % to 40.0 wt. % of molecules having a number of aromatic rings in the range of from 3.0 to 5.0, based on the weight of the hydroprocessed product. Depending primarily on the third mixture's sulfur content, the hydroprocessed product can have, e.g., a sulfur content in the range of 0.01 wt. % to 3.5 wt. % based on the weight of the product.

In certain embodiments, the hydroprocessed product has a sulfur content that is ≤0.5 times (wt. basis) that of the third mixture and a TH content ≤0.7 times the TH content of the third mixture. Generally, the hydroprocessed product comprises ≥20.0 wt. % of the liquid-phase portion of the hydroprocessor effluent (based on the weight of the liquid-phase portion of the hydroprocessor effluent), e.g., ≥40.0 wt. %, such as in the range of 20.0 wt. % to 70.0 wt. % or in the range of 40.0 wt. % to 60.0 wt. %. When the hydroprocessing is operated under the conditions specified in the preceding section utilizing as a feed the specified third mixture (e.g., an SCT stream), hydroprocessed product generally has a density ≥0.97 g/$cm^3$ at 15° C., such as o≥1.00 g/$cm^3$ at 15° C., and a viscosity ≤90.0% that of the third mixture's viscosity, e.g., ≤75.0% that of the third mixture's viscosity. Generally, ≥50.0 wt. % the hydroprocessed product is in the form of multi-ring aromatic and non-aromatic molecules having a number of carbon atoms ≥16 based on the weight of the hydroprocessed product, e.g., ≥75.0 wt. %, such as ≥90.0 wt. %. Optionally, ≥50.0 wt. % the hydroprocessed product is in the form of multi-ring molecules. These can have, e.g., a number of carbon atoms in the range of from 25 to 40 based on the weight of the hydroprocessed product.

If desired, at least a portion of the light hydrocarbon mixture and/or at least a portion of the hydroprocessed product can be utilized within the process and/or conducted away for storage or further processing. For example, the relatively low viscosity of the hydroprocessed product compared to that of the third mixture can make it desirable to utilize at least a portion of the hydroprocessed product as a diluent (e.g., a flux) for heavy hydrocarbons, especially those of relatively high viscosity. In this regard, the hydroprocessed product can substitute for more expensive, conventional diluents. Non-limiting examples of heavy, high-viscosity streams suitable for blending with the hydroprocessed product (or with the entire liquid-phase portion of the hydroprocessor effluent) include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. In an embodiment, the hydroprocessed product is utilized in a blend, the blend comprising (a) ≥10.0 wt. % of the hydroprocessed product and (b) ≥10.0 wt. % of a fuel oil having a sulfur content in the range of 0.5 wt. % to 3.5 wt. and a viscosity in the range of 100 cSt to 500 cSt at 50° C., the weight percents being based the weight of the blend.

In an embodiment, the hydroprocessed product can be utilized for fluxing and conducting away a high-viscosity bottoms from a vapor-liquid separation device, such as those integrated with a pyrolysis furnace. In certain embodiments, ≥10.0% of the hydroprocessed product (on a wt. basis) e.g., ≥50.0%, such as ≥75.0%, can be combined with ≥10.0% (on a wt. basis) of the bottoms fraction, e.g., ≥50.0%, such as ≥75.0%, in order to lessen the bottom's viscosity. In certain embodiments, at least a portion of the light hydrocarbon mixture is recycled upstream of the hydroprocessing stage for use as all or a portion of the utility fluid. For example, ≥10.0 wt. % of the light hydrocarbon mixture can be utilized as the utility fluid, such as ≥90.0 wt. %, based on the weight of the light hydrocarbon mixture. When the amount of light hydrocarbon mixture is not sufficient to produce the desired amount of utility fluid, a make-up portion of utility fluid can be provided to the process from another source.

In one or more embodiments, low and high boiling-range cuts are separated from at least a portion of the hydroprocessed product, e.g., at a cut point in the range of about 320°

C. to about 370° C., such as about 334° C. to about 340° C. With a cut point in this range, ≥40.0 wt. % of the hydroprocessed product is generally contained in the lower-boiling fraction, e.g., ≥50.0 wt. %, based on the weight of the hydroprocessed product. At least a portion of the lower-boiling fraction can be utilized as a flux, e.g., for fluxing vapor/liquid separator bottoms, primary fractionator bottoms, etc. At least a portion of the higher-boiling fraction can be utilized as a fuel, for example.

Alternatively, or in addition, the process can further comprise hydrogenating or treating at least a portion of the hydroprocessed product of any the above embodiments to produce a naphthenic lubricating oil.

Example 1

This example illustrates the conversion of steam cracked tar to hydroprocessed product.

The hydroprocessing is carried out in a fixed bed reactor having an approximately 0.3" ID (inside diameter) stainless tube reactor body and three heating blocks. The reactor was heated by a three-zone furnace. Table 1 shows details of the catalyst used in the experiment. 12.6 g (17.5 $cm^3$) of RT-621, sized to 40-60 mesh, was loaded into the zone of the reactor within the furnace.

TABLE 1

| Catalyst Description | |
|---|---|
| Catalyst | RT-621 |
| Size | 1/16" cylindrical extrudate, sized to 40-60 mesh for testing |
| Catalyst volume | 17.5 $cm^3$ |
| Catalyst weight | 12.6 g |

After loading the reactor, the unit is pressure tested at 1000 psig (68.9 bar gauge) with molecular nitrogen followed by molecular hydrogen. The catalyst was sulfided with a 200 $cm^3$ of sulfiding solution containing 80 wt. % 130N lubricating oil basestock and 20 wt. % ethyldisulfide (FW 122.25, S=32.06, 10.5 wt. % S, 0.324 mole S/100 $cm^3$ feed) based on the weight of the sulfiding solution. The details are as follows.

1. Set reactor pressure 750 psig (51.7 bar gauge).
2. Start ISCO pump containing 200 $cm^3$ of sulfiding solution at 60 $cm^3$/hr for about one hour until the pressure transducer reaches 750 psig (51.7 bar gauge) (to soak the catalyst at ambient temperature of approximately 25° C.).
3. Reduce ISCO pump rate to 2.5 cc/hr. Start molecular hydrogen flow at 20 SCCM.
4. Catalyst Sufiding:

Ramp reactor from room temperature to 110° C. at 1° C./min, hold at 110° C. for 1 hr (duration: 2.5 hr.);

Ramp reactor from 110° C. to 250° C. at 1° C./min, hold at 250° C. for 12 hr. (duration: 14 h and 20 min., with most of the sulfiding occurring at 250° C.);

Ramp reactor from 250° C. to 340° C. at 1° C./min, and hold at 340° C. until the pump is empty (duration of about 1.5 hr.+final holding at 340° C.).

After sulfiding, a feed (60 wt. % SCT/40 wt. % trimethylbenzene) was introduced at 6.0 $cm^3$/hr. (0.34 LHSV), the molecular hydrogen flow was increased to 54 $cm^3$/min (3030 SCF/B), the reactor temperature was ramped up at 1° C./min to 425° C. while the reactor pressure was maintained at 750 psig (51.7 bar gauge). Table 2 shows the properties of 1,2,4-trimentylbenzene used as the utility fluid in the experiment.

TABLE 2

| Utility Fluid Description | |
|---|---|
| Solvent | 1,2,4-Trimethylbenzene (TMB) |
| CAS # | 95-63-6 |
| Source | Aldrich, T7360-1 |
| Purity. | 98% min |
| Mol. Wt. | 120.2 |
| Density | 0.889 |
| Boiling point, ° C. | 168 |
| Critical temperature, ° C. | 377 |

A SCT sample is obtained from a commercial steam cracker primary fractionator bottoms stream. Table 3 lists the typical properties for the SCT sample. Note that the sample contains about 2.2 wt. % of sulfur and a viscosity of 988 cSt at 50° C.

TABLE 3

Summary of properties for SCT feed and hydroprocessed product.

| | SCT feed | hydroprocessed product | hydroprocessed product |
|---|---|---|---|
| Days on Stream | | 8 | 20 |
| Reaction Temp., ° C. | | 425 | 400 |
| Reaction Pressure, psig (bar g) | | 768 (52.9) | 1002 (69.09)) |
| LHSV, $hr^{-1}$ | | 0.34 | 0.34 |
| H2 circulation, SCF/B | | 3032 | 1011 |
| Sulfur, wt. % | 2.2 | 0.06 | 0.30 |
| Viscosity at 50° C. | 988 | 5.8 | 12.8 |

The liquid-phase portion of the hydroprocessor effluent (total liquid product or "TLP") is collected from the units at intervals. For several such TLP samples the trimethylbenzene is removed by rotary evaporation to yield an essentially solvent-free hydroprocessed product. Analytical tests are performed at different times during the run to determine, e.g., sulphur content, viscosity, hydroprocessed product composition by 2D GC, and conversion by simulated distillation, for the hydroprocessed product.

The hydroprocessed product composition is determined by the combined use of 2D GC and simulated distillation. 2D GC quantified the molecules that boil below roughly 565° C. (1050° F.) while simulated distillation determined the amount of hydroprocessed product fraction that boils above 565° C. (1050° F.). Table 4 summarizes the compositional results for two hydroprocessed product samples taken during the run at 8 and 20 days-on-stream in addition to the composition of the feed. "Sats" refers to paraffinic molecules and 565° C.+ refers to the amount of hydroprocessed fraction that boils above 565° C. (1050° F.).

TABLE 4

| | SCT Tar | Hydroprocessed Product | Hydroprocessed Product |
|---|---|---|---|
| Days on stream | | 8 | 20 |
| Species | wt. % | wt. % | wt. % |
| Sats | 1.3 | 3.8 | 3.5 |
| 1-Ring | 0.3 | 15.3 | 9.2 |
| 1.5-Ring | 1.3 | 16.4 | 16.8 |
| 2.0-Ring | 17.5 | 19.8 | 18.1 |
| 2.5-Ring | 11.6 | 15.9 | 15.2 |
| 3.0-Ring | 24.0 | 12.2 | 12.8 |
| 3.5-Ring | 10.7 | 8.2 | 8.9 |
| 4.0-Ring | 8.2 | 2.9 | 3.7 |
| 4.5-Ring | 6.2 | 1.7 | 2.1 |
| 5.0-Ring | 2.7 | 0.9 | 1.5 |

TABLE 4-continued

| | SCT Tar | Hydroprocessed Product | Hydroprocessed Product |
|---|---|---|---|
| 5.5-Ring | 0.7 | 0.3 | 0.4 |
| 565° C.+ | 15.5 | 2.6 | 7.4 |

Note that there is significant reduction in heavy molecules, including 4-ring plus molecules. However, the most notable from the compositional changes after the hydroprocessed reactions is the significant increase in 1-ring and 1.5-ring aromatics. For example, the feed contains very little 1- and 1.5-ring aromatics (1.6 wt. %). After the hydroprocessed reaction, the sum of 1-ring and 1.5-ring aromatics increased significantly to 31.7 wt. % for 8 days-on-stream sample, and to 26 wt. % for the 20 days-on-stream sample. The change in the sum of 1 ring and 1.5 ring aromatics is 1900% and 1500%, respectively, for the 8 and 20 days-on-stream samples. The conversion of tar heavies to lighter molecules such as 1-ring and 1.5-ring aromatics is believed to be the reason that leads to the significant reduction in viscosity of hydroprocessed product.

The two hydroprocessed product compositions have a viscosity of 5.8 cSt at 50° C. for the 8 DOS sample and 12.8 cSt at 50° C. for the 20 DOS sample, respectively. Compared with typical specifications for RSFO, the hydroprocessed products have a significant viscosity premium. Hydrocarbon processors typically use expensive streams such as kerojet as flux to blend high viscosity hydrocarbon streams such as vacuum resid to meet fuel oil viscosity spec.

Alternatively, one can separate the hydroprocessed product into a flux fraction and a heavy bottom fraction, e.g., using fractionation. For ease of comparison, the viscosity of the flux fraction is set to be equal to that of SCGO while the heavy bottom fraction to be equal to the tar feed viscosity.

Note that roughly 54 wt. % of the 8 DOS sample is upgraded to SCGO flux value while the rest (the heavy bottom) is equivalent to the tar starting materials. For the 20 DOS sample, the amount of flux upgrade is ca. 40 wt. %.

There are advantages with an added separation step. For example, the heavies in hydroprocessed products might cause a compatibility issue with fuel oil, which leads to precipitation of heavies in fuel oil after blending. By separating the hydroprocessed product into a light fraction and a heavy fraction, one monetizes the much higher value with the flux upgrade. The heavy fraction is used in the same way as tar would have been used, e.g., as carbon black feedstock or as boiler fuel.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydroprocessed tar, comprising: ≥10.0 wt. % based on the weight of the hydroprocessed tar of compounds selected from the group consisting of:

(i) compounds in the 1.0 ring molecular class, (ii) compounds in the 1.5 ring molecular class, (iii) compounds defined in (i) or (ii) further comprising one or more alkyl or alkenyl substituents on any ring, (iv) compounds defined in (i), (ii) or (iii) further comprising hetero atoms selected from sulfur, nitrogen or oxygen, and (v) combinations thereof;

wherein the hydroprocessed tar has a viscosity ≥2.0 cSt at 50° C., and ≥1.0 wt. % of the hydroprocessed tar comprises compounds having an atmospheric boiling point ≥565° C. and wherein the weight ratio of the compounds of ring classes 1.0 to 2.0 to compounds having a ring class of 3.0 or more is about 1.1 to about 1.3, based on the total weight of the hydroprocessed tar.

2. The hydroprocessed tar of claim 1, wherein the hydroprocessed tar comprises ≥20 wt. % based on the weight of the hydroprocessed tar of compounds selected from the group consisting of:

(i) compounds in the 1.0 ring molecular class, (ii) compounds in the 1.5 ring molecular class, (iii) compounds defined in (i) or (ii) further comprising one or more alkyl or alkenyl substituents on any ring, (iv) compounds defined in (i), (ii) or (iii) further comprising hetero atoms selected from sulfur, nitrogen or oxygen, and (v) combinations thereof.

3. The hydroprocessed tar of claim 1, wherein the hydroprocessed tar has a sulfur content in the range of 0.01 wt. % to 3.5 wt. % based on the weight of the tar.

4. The hydroprocessed tar of claim 1, wherein the hydroprocessed tar comprises ≤50.0 wt. %, based on the weight of the hydroprocessed tar, of compounds in the ring molecular classes of from 3.0 to 5.0 including compounds with one or more alkyl or alkenyl substituents on any ring, and comprising hydrocarbons and hydrocarbons containing one or more hetero atoms selected from sulfur, nitrogen or oxygen.

5. The hydroprocessed tar of claim 4, wherein the hydroprocessed tar comprises 20.0 wt. % to 40.0 wt. % of molecules having a number of aromatic rings in the range of from 3.0 to 5.0, based on the weight of the hydroprocessed tar.

6. The hydroprocessed tar of claim 1, wherein the hydroprocessed tar comprises 20.0 wt. % to 40.0 wt. % based on the weight of the hydroprocessed tar of compounds selected from the group consisting of:

(i) compounds in the 1.0 ring molecular class, (ii) compounds in the 1.5 ring molecular class, (iii) compounds defined in (i) or (ii) further comprising one or more alkyl or alkenyl substituents on either ring, (iv) compounds defined in (i), (ii) or (iii) further comprising hetero atoms selected from sulfur, nitrogen or oxygen, and (v) combinations thereof.

7. The hydroprocessed tar of claim 1, wherein the hydroprocessed tar has a viscosity in the range of 3.0 cSt to 50.0 cSt at 50° C.

8. A hydroprocessed pyrolysis tar, comprising ≥10.0 wt. % based on the weight of the hydroprocessed pyrolysis tar of compounds selected from the group consisting of:

(i) compounds in the 1.0 ring molecular class, (ii) compounds in the 1.5 ring molecular class, (iii) compounds defined in (i) or (ii) further comprising one or more alkyl or alkenyl substituents on any ring, (iv) compounds defined in (i), (ii) or (iii) further comprising hetero atoms selected from sulfur, nitrogen or oxygen, and (v) combinations thereof;

wherein the hydroprocessed pyrolysis tar has a viscosity ≥2.0 cSt at 50° C., and ≥1.0 wt. % of the hydroprocessed pyrolysis tar comprises compounds having an atmospheric boiling point ≥565° C. and wherein the weight ratio of the compounds of ring classes 1.0 to 2.0 to compounds having a ring class of 3.0 or more is about 1.1 to about 1.3, based on the total weight of the hydroprocessed tar.

9. The hydroprocessed pyrolysis tar of claim 8, wherein the hydroprocessed pyrolysis tar comprises ≥90.0 wt. % of hydroprocessed SCT based on the weight of the hydroprocessed pyrolysis tar.

10. A hydroprocessed tar, comprising: ≥10.0 wt. % based on the weight of the hydroprocessed tar of compounds selected from the group consisting of:

(i) compounds in the 1.0 ring molecular class, (ii) compounds in the 1.5 ring molecular class, (iii) compounds defined in (i) or (ii) further comprising one or more alkyl or alkenyl substituents on any ring, (iv) compounds defined in (i), (ii) or (iii) further comprising hetero atoms selected from sulfur, nitrogen or oxygen, and (v) combinations thereof;

wherein the hydroprocessed tar has a viscosity ≥2.0 cSt at 50° C., and 2.0 to 10.0 wt. % of the hydroprocessed tar comprises compounds having an atmospheric boiling point ≥565° C., the weight percent being based on the weight of the hydroprocessed tar, wherein the weight ratio of the compounds of ring classes 1.0 to 2.0 to compounds having a ring class of 3.0 or more is about 1.1 to about 1.3, based on the total weight of the hydroprocessed tar.

* * * * *